US005229166A

United States Patent [19]

Grossmann et al.

[11] Patent Number: 5,229,166

[45] Date of Patent: Jul. 20, 1993

[54] CIGARETTE FILTER ROD AND METHOD OF MAKING SAME

[75] Inventors: Michel Grossmann, Gorgier; Eduard Ringgenberg, Bôle, both of Switzerland

[73] Assignee: Fabriques de Tabac Reunies, S.A., Neuchatel, Switzerland

[21] Appl. No.: 921,407

[22] Filed: Jul. 31, 1992

Related U.S. Application Data

[63] Continuation of Ser. No. 641,648, Jan. 15, 1991, abandoned.

[30] Foreign Application Priority Data

Jan. 31, 1990 [CH] Switzerland ..... 00315/90-0

[51] Int. Cl.[5] ..... B05D 5/10; B05D 5/00; B05D 1/02

[52] U.S. Cl. ..... 427/207.1; 427/208.6; 427/286; 427/288; 427/424

[58] Field of Search ..... 427/207.1, 208.6, 286, 427/288, 424

[56] References Cited

U.S. PATENT DOCUMENTS

| | | | |
|---|---|---|---|
| 3,619,328 | 11/1971 | Preston et al. | 156/461 |
| 4,229,475 | 10/1980 | Barrett et al. | 427/286 X |

FOREIGN PATENT DOCUMENTS

| | | | |
|---|---|---|---|
| 0276557 | 8/1988 | European Pat. Off. | 427/208.6 |
| 1305023 | 1/1973 | Fed. Rep. of Germany . | |
| 3401588 | 8/1984 | Fed. Rep. of Germany . | |
| 3525889 | 10/1986 | Fed. Rep. of Germany . | |
| 8803131 | 6/1988 | Fed. Rep. of Germany . | |
| 2120842 | 8/1972 | France . | |
| 2290167 | 6/1976 | France . | |
| 2374214 | 7/1978 | France . | |
| 2421682 | 11/1979 | France . | |
| 2623108 | 5/1989 | France . | |
| 950718 | 2/1964 | United Kingdom | 427/207.1 |
| 2029280 | 3/1980 | United Kingdom . | |
| 2053740 | 2/1981 | United Kingdom . | |

*Primary Examiner*—Marianne Padgett
*Attorney, Agent, or Firm*—Jeffrey H. Ingerman

[57] ABSTRACT

A method of forming a gummed band on a web of paper (1) is provided. A marginal band (7) forming a seam is projected by one (10) of two devices (10, 11) under the action of compressed-air pressure, the air being preheated (20) and passing into a feed line (19), whereas an inside gummed band (6) is formed by the other device (11) fed with cold compressed air through a duct (21). An adhesive is contained in a reservoir (8), kept under pressure by means of a tube (12), and reaches the projection device through another duct (9).

6 Claims, 3 Drawing Sheets

CIGARETTE FILTER ROD AND METHOD OF MAKING SAME

This is a continuation of application Ser. No. 07/641,648, filed Jan. 15, 1991, entitled CIGARETTE FILTER ROD AND METHOD OF MAKING SAME, now abandoned.

This invention relates to the manufacture of filter rods for cigarettes, and more particularly to a method of gumming one or more longitudinal zones of a strip of paper intended to form the wrapper of a rod, especially in the tobacco industry. The invention further relates to a cigarette filter rod obtained by this method.

The application of adhesive to the webs of paper intended to form the cylindrical wrappers of rods, especially in the tobacco industry, is an operation which must satisfy multiple requirements. The simplest and most widely adopted solution until now has been to use a liquid adhesive, e.g., polyvinyl acetate, at room temperature and to gum the connection zones which will later form the seams by transferring this liquid adhesive to the paper web, e.g., by means of a thin rotating disk, part of the periphery of which is immersed in an adhesive reservoir. For example, West German Patent Application No. 34 01588 describes an improvement to applicators of this kind. Instead of disk-type applicators, pasting apparatus provided with a nozzle which opens upon contact with the paper has likewise been proposed for depositing a polyvinyl acetate adhesive (cf. U.S. Pat. No. 3,619,328).

However, a major drawback of such apparatus is that it cannot be used with the highly porous papers which are increasingly being utilized, particularly in the manufacture of filter-tip rods. Such apparatus has other drawbacks as well, especially that the speed of application is limited.

More recently, it has been proposed that adhesives having a high melting point, which solidify at room temperature and which must consequently be applied hot, be used for the pasting operation. For this purpose, devices which project the liquid adhesive onto the paper web may be used; and West German Patent No. 3,525,889, for example, describes the design of a projection nozzle adapted to this technique. The latter is advantageous in certain cases, especially when the pasted seam has high strength requirements, but it is delicate to apply. The method is expensive, the speed of application is also relatively limited, and finally, the use of hot liquid adhesive is not suitable for the highly porous papers mentioned above.

The use of spray applicators has also been proposed for depositing so-called "structural" adhesives or polychloroprene and acrylic adhesives; cf. French Disclosed Application No. 2,623,108. However, the contents of this last disclosure do not permit arriving at a reliable solution to the currently posed problem of pasting the wrappers of rods in the tobacco industry.

It is therefore an object of this invention to provide a simple, improved gumming method by means of which the gumming operation can be carried out at high speed on all types of paper, particularly highly porous papers.

A further object of the invention is to provide such a method which is as inexpensive to carry out as possible.

To this end, in the gumming method according to the present invention, the improvement comprises the steps of placing one or more projection devices at a fixed location, causing the strip to pass by in front of the projection device or devices at a predetermined distance other than zero, feeding the projection device or devices with a liquid adhesive at room temperature and with compressed air, and actuating the projection device or devices so as to project onto each longitudinal zone to be pasted a jet of fine droplets of adhesive.

Still another object of this invention is to provide an improved cigarette filter rod obtained by the foregoing method.

To this end, according to another aspect of the present invention, the filter rod comprises a cylindrical wrapper formed of a strip of highly porous paper, the edges of which overlap and are fixed together by a seam of polyvinyl acetate adhesive.

A preferred embodiment of the invention will now be described in detail with reference to the accompanying drawings, in which.

Figure 1:
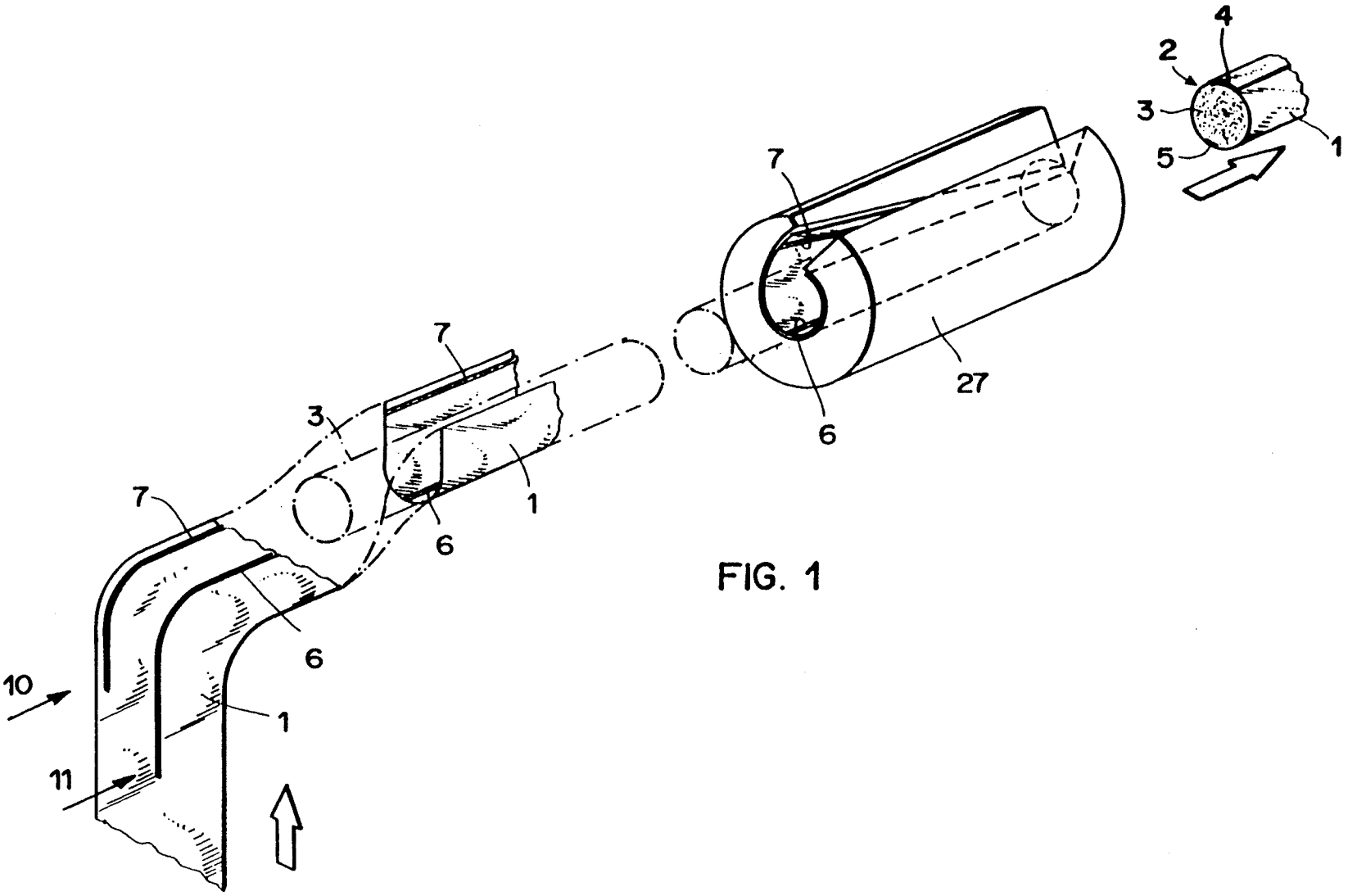
FIG. 1 is a diagrammatic exploded perspective view showing the travel of a web of paper during the formation of a cigarette filter-tip rod.

FIG. 1 shows a paper web 1 which runs at high speed through an installation so as to constitute the wrapper of a cigarette filter-tip rod 2. When rod 2 is formed, web 1 constitutes a cylindrical wrapper which surrounds a filtering mass 3 of cellulose acetate, and the two edges of which overlap and are fixed to one another by an adhesive seam 4. Another adhesive joint 5 is situated in the center of web 1 and connects it to filtering mass 3.

In order to allow high-speed pasting, web 1 continuously receives on its central zone 6 a jet of liquid adhesive forming the inside joint in the form of a middle band. Furthermore, along one of its edges, it receives a second jet of adhesive which forms a marginal band 7 constituting the seam band. Bands 6 and 7 are each about 2 mm wide.

After having received the horizontally projected adhesive bands 6 and 7, web 1 is led into a rod-forming device which is known per se and is depicted only diagrammatically in FIG. 1. Guide means lift the edges of web 1 to give it a U shape into which a continuous rod 3 of cellulose acetate, constituting the filter material, is fitted. The assembly consisting of web 1 and filler 3 then passes into a closure guide 27 in which the two edges of web 1 are overlapped on mass 3 and pressed against one another, thus causing connecting zones 6 and 7 to adhere.

The rod is then dried and cut into segments which are incorporated into cigarettes in the course of later operations.

Figure 2:
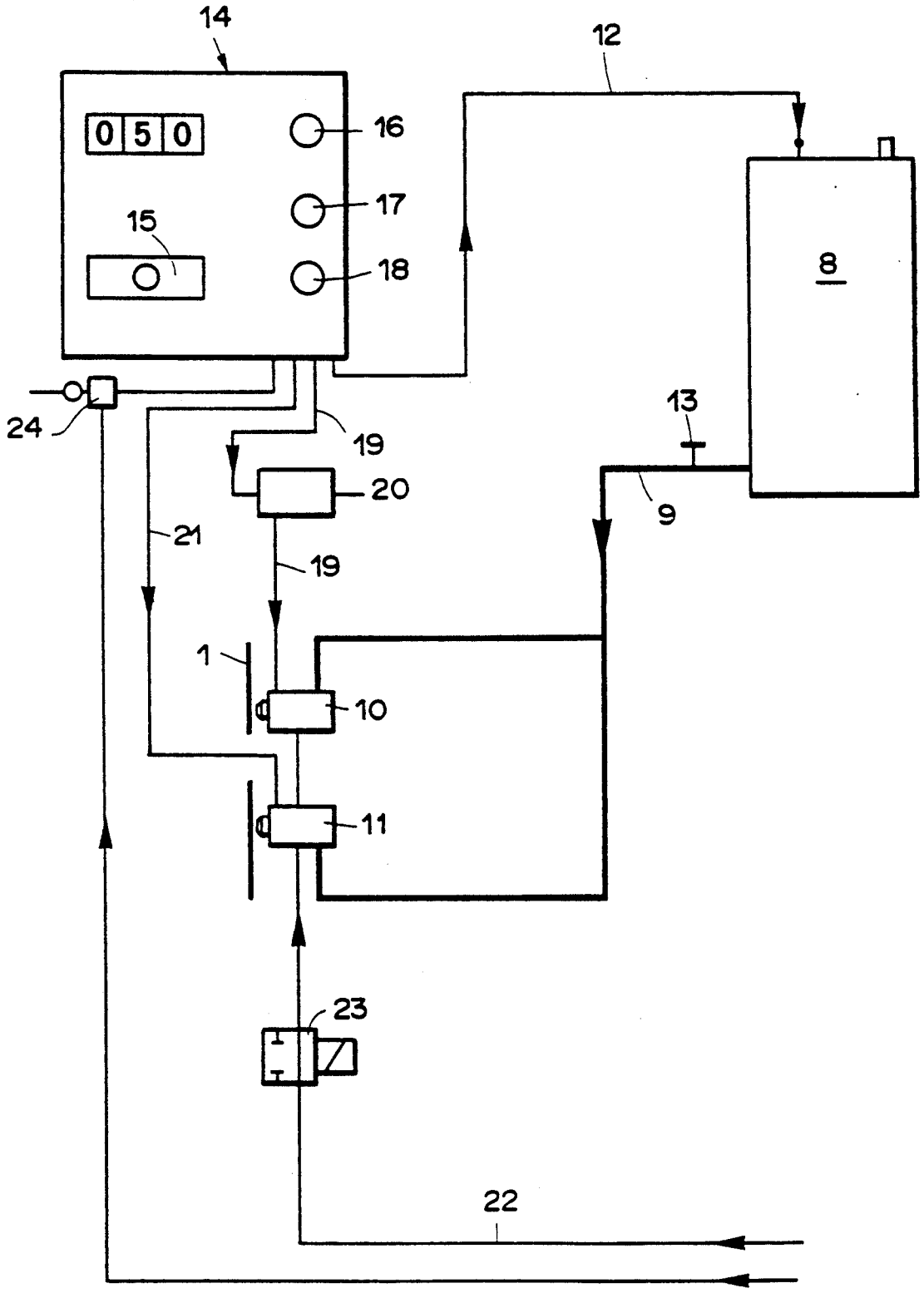
FIG. 2 is a diagram of various components of a gumming installation for gumming the paper web seen in FIG. 1.
Figure 3:
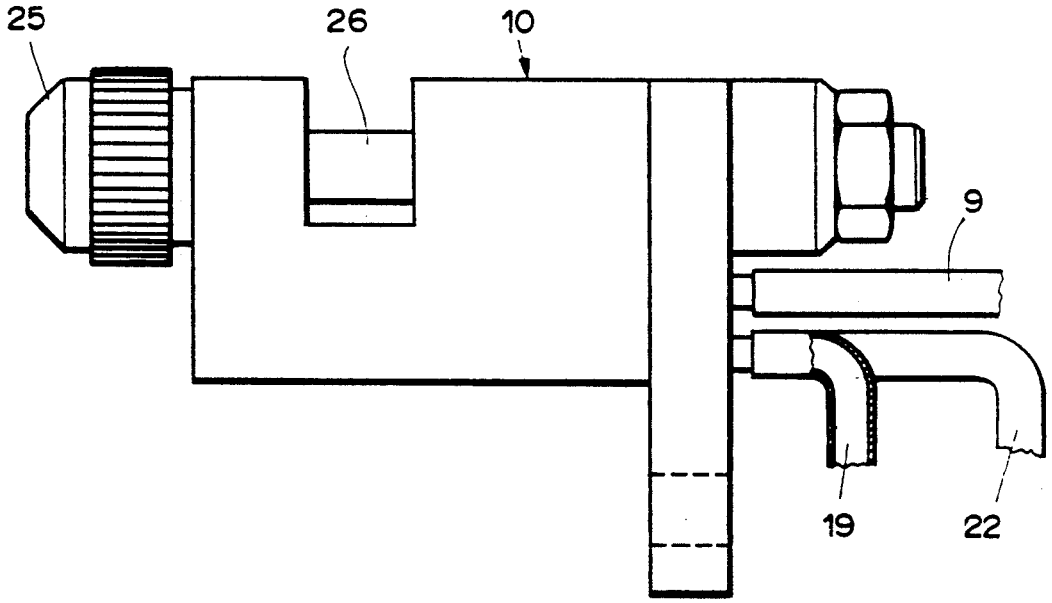
FIG. 3 is an elevation of an adhesive projector usable in the installation of FIG. 2.

The means used for depositing the two bands of adhesive 6 and 7 are depicted in more detail in FIGS. 2 and 3.

FIG. 2 shows the contemplated installation as a whole. This installation comprises a completely closed adhesive reservoir 8 from which a duct 9 carries the liquid adhesive to two projectors 10 and 11 placed in front of web 1 at fixed locations so as to project the bands of adhesive 6 and 7 onto web 1. Through a tube 12, compressed air is admitted into the upper part of reservoir 8 in order to put the liquid adhesive contained therein under pressure. By means of a valve 13 and a connection piece on duct 9, adhesive can be fed to reservoir 8 whenever necessary.

The installation requires a compressed air feed, together with regulating and control means acting on this feed. A control panel 14 comprises, in addition to a control switch 15, adjustable escape-valves 16, 17, and 18, thus permitting regulation of the pressures of air going firstly to reservoir 8 through tube 12, and secondly to projector 10 through a line 19 into which a heating device 20 is inserted, and finally into a duct 21 which feeds projector 11. Projection devices 10 and 11 are likewise fed with through a control valve 23. This control permits working of the needle-valves of the projectors, as will be seen below. The overall feed of panel 14 is effected from a compressed-air source through a pre-regulating escape-valve 24.

It has been found that it is possible to obtain an installation operating faultlessly and satisfying the most rigorous requirements by using projection devices of very simple and ordinary design, such as device 10 shown in FIG. 3. This device comprises three intake couplings situated at the rear and respectively connected to ducts 9, 19, and 22. In the case of device 11, the spray-air delivery tube will be tube 21 rather than tube 19.

Device 10 comprises a nozzle 25 provided with a calibrated aperture at its front end. A movable needle-valve 26 is biased by a spring so as to be held in a position in which it closes the aperture of nozzle 25. The air pressure arriving through duct 22 causes the retraction of valve 26 and, consequently, the opening of nozzle 25. A mixture of air and liquid coming from the two ducts 9 and 19 is then brought to behind the aperture of nozzle 25 and projects a jet of fine droplets of liquid onto web 1 which is traveling at high speed in front of this nozzle, at a certain distance, e.g., on the order of 4 mm. It has been found that different particularities permit results to be obtained which fully satisfy the conditions.

Thus, it is preferable to pre-heat the projection air of the mixture intended to form seam 7.

In any case, metering of the adhesive as regards the degree of fluidity and its capillarity characteristics must be adjusted by means of preliminary trials as a function of the desired speed of travel and type of the paper to be pasted. Similarly, the compressed-air pressures must be exactly determined from case to case, as stated above.

As in any compressed-air-flow projection device, the diameter of the droplets and the rate of projection depend upon the characteristics of the nozzle aperture, as well as on the size and shape of the inner chamber in which mixture takes place.

It has been found that the projection device described above, which is extremely simple, yields reliable gumming even on highly porous papers at hitherto unattainable speeds, e.g., on the order of 400 m/min.

Tests have even shown that it is possible to envisage an increase in the speeds of travel up to some 600 m/min.

The adhesive which is deposited by projection onto the fibers of the paper, in very fine droplets, does not penetrate into the paper. Thus reliable joining is obtained, especially at the seam, without any gumming up of the machines, even with highly porous paper.

What is claimed is:

1. A method of gumming one or more longitudinal zones of a web of paper intended to form the wrapper of a rod, especially in the tobacco industry, said paper being capable of being penetrated by liquid adhesive, said method comprising the steps of:

disposing one or more projection means at a fixed location;

causing said web to pass by in front of said one or more projection means at a distance therefrom other than zero;

feeding said one or more projection means with said liquid adhesive at room temperature and with compressed air, thereby forming a mixture of air and said liquid adhesive within said projection means; and actuating said one or more projection means to form therein from said mixture a jet of fine droplets of adhesive and to project onto each longitudinal zone to be gummed said jet of fine droplets of adhesive for gumming each said longitudinal zone substantially without penetrating said web in said zone.

2. The method of claim 1, wherein said adhesive is a polyvinyl acetate adhesive.

3. The method of claim 1, wherein said paper is a high-porosity paper.

4. The method of claim 1, wherein said one or more projection means are fed with said liquid adhesive from a reservoir, further comprising the step of maintaining said adhesive under a regulated pressure in said reservoir.

5. The method of claim 4, wherein said adhesive is maintained under pressure by means of compressed air.

6. The method of claim 1, wherein said distance is about 4 mm.

* * * * *